US011168842B2

(12) United States Patent
Haberkorn et al.

(10) Patent No.: US 11,168,842 B2
(45) Date of Patent: Nov. 9, 2021

(54) LAMP

(71) Applicant: LEDVANCE GmbH, Garching bei München (DE)

(72) Inventors: Lene Haberkorn, Köigsbronn (DE); Klaus Eckert, Herbrechtingen (DE)

(73) Assignee: LEDVANCE GMBH, Garching bei München (DE)

( * ) Notice: Subject to any disclaimer, the term of this patent is extended or adjusted under 35 U.S.C. 154(b) by 617 days.

(21) Appl. No.: 16/076,099

(22) PCT Filed: Feb. 17, 2017

(86) PCT No.: PCT/EP2017/053683

§ 371 (c)(1),
(2) Date: Aug. 7, 2018

(87) PCT Pub. No.: WO2017/140885

PCT Pub. Date: Aug. 24, 2017

(65) Prior Publication Data

US 2021/0190273 A1 Jun. 24, 2021

(30) Foreign Application Priority Data

Feb. 19, 2016 (DE) ..... 102016202621.6

(51) Int. Cl.

| | |
|---|---|
| ***F21K 9/232*** | (2016.01) |
| ***F21K 9/238*** | (2016.01) |
| ***F21K 9/90*** | (2016.01) |
| ***F21V 23/00*** | (2015.01) |
| ***F21V 23/06*** | (2006.01) |
| *F21Y 115/10* | (2016.01) |
| *H01K 1/46* | (2006.01) |

(52) U.S. Cl.

CPC ..... *F21K 9/232* (2016.08); *F21K 9/238* (2016.08); *F21K 9/90* (2013.01); *F21V 23/004* (2013.01); *F21V 23/06* (2013.01); *F21Y 2115/10* (2016.08); *H01K 1/46* (2013.01)

(58) Field of Classification Search

None

See application file for complete search history.

(56) References Cited

U.S. PATENT DOCUMENTS

| | | | |
|---|---|---|---|
| 9,377,185 | B2 | 6/2016 | Preuschl |
| 2008/0062703 | A1 | 3/2008 | Cao |
| 2013/0271990 | A1 | 10/2013 | Hussell et al. |
| 2015/0062928 | A1 | 3/2015 | Mostoller et al. |
| 2015/0300619 | A1 | 10/2015 | Reier |

FOREIGN PATENT DOCUMENTS

| | | | |
|---|---|---|---|
| DE | 102009054519 | A1 | 6/2011 |
| DE | 202014004861 | U1 | 6/2014 |
| DE | 102014214603 | A1 | 1/2016 |

*Primary Examiner* — Vip Patel

(74) *Attorney, Agent, or Firm* — Hayes Soloway PC

(57) ABSTRACT

A lamp includes a base, a light-permeable bulb containing at least one light source, and a driver for powering the light source. The driver is located within the base. The bulb has outwardly leading supply lines on the base side, and the driver has at least one contact element which projects in the direction of the bulb into which a free-standing section of the respective supply line is inserted to make contact. The technology is particularly applicable to lamps with LEDs as light sources, in particular for replacement of conventional lamps such as incandescent lamps.

13 Claims, 12 Drawing Sheets

LAMP

CROSS-REFERENCE TO RELATED APPLICATION AND PRIORITY

This patent application is a U.S. National Stage of International Patent Application No. PCT/EP2017/053683 filed on Feb. 17, 2017, which claims priority from German Patent Application No. 10 2016 202 621.6 filed on Feb. 19, 2016. Each of these patent applications is herein incorporated by reference in its entirety.

TECHNICAL FIELD

The invention relates to a lamp comprising: a base; a light-permeable bulb that contains at least one light source; and within the base, a driver for supplying the at least one light source with electrical operating signals, which the bulb has outwardly leading supply lines on the base side. The invention, in particular, is applicable to lamps with LEDs as light sources, in particular for replacement of conventional lamps, such as incandescent lamps, etc.

BACKGROUND

Lamps of the relevant type with a glass bulb filled with noble gas are known, in which the supply lines leading through the glass bulb are electrically connected by means of flexible wires to the driver. For assembly, comparatively long wires are used, which are connected to the supply lines and the driver by soldering. Only then does joining of the glass bulb and the base begin.

Alternatively, for assembly the driver can first be electrically contacted with the glass bulb and then positioned on the glass bulb. Only then is the base added, which in turn, is electrically contacted with the driver.

SUMMARY OF THE INVENTION

The object of the present invention is to overcome the disadvantages of the prior art at least partially and, in particular, to provide a particularly simple electrical contact between a bulb and a driver arranged in a base, in particular even if the driver is located at an inaccessible point in the base.

This object is achieved according to the features of the independent claims. Preferred embodiments are disclosed, in particular by the dependent claims.

The invention relates to a lamp comprising: a base; a light-permeable bulb which contains at least one light source, and a driver located in the base for supplying the at least one light source with electrical operating signals, wherein the bulb has outwardly leading supply lines on the base side, wherein the driver has at least one contact element which projects in the direction of the bulb into which a free-standing section of the respective power supply line is inserted to make contact.

This lamp has the advantage that the base can be manufactured and tested as a complete part with integrated driver and the contact elements. Simply fitting the base with the bulb produces the finished lamp. In this case, the supply lines can be particularly, reliably brought into secure contact with the respective contact elements. In particular, no narrow tolerances are required, for example tolerances with respect to a position or situation of the free-standing section of the supply line. This widening of the tolerance ranges enables a cost reduction in the production of the individual components and in the contacting of the bulb to the driver. As a result, rejections when marrying bulbs and drivers can be reduced. A further advantage is produced in that without further action, different base types can be connected to a bulb, for example Edison bases of the E27, E26 type, etc. or bayonet bases of the B22d, B25d type, etc.

The base can be for example latched and/or bonded to the bulb. It can be made of metal, for example of aluminum.

The light-permeable bulb can be a transparent or a translucent or opaque (for example milky white) bulb. The bulb can be a glass bulb or a plastic bulb. The bottom can be designed, in particular, as a plate base or plate foot.

The light source can be, in particular, a semiconductor light source. In a further embodiment the at least one semiconductor light source comprises or has at least one light-emitting diode. If a plurality of light-emitting diodes are present they can illuminate in the same color or in different colors. A color can be monochromatic (for example red, green, blue, etc.) or polychromatic (for example white). The light emitted by the at least one light-emitting diode can also be an infrared light (IR LED) or an ultraviolet light (UV LED). A plurality of light-emitting diodes can generate a mixed light, for example a white mixed light. The at least one light-emitting diode can contain at least one wavelength-converting fluorescent substance (conversion LED). Alternatively or additionally, the fluorescent substance may be arranged remote from the light-emitting diode ("remote phosphorus"). The at least one light-emitting diode can be present in the form of at least only individually housed light-emitting diode or in the form of at least one LED chip. A plurality of LED chips can be mounted on a common substrate ("submount"). The at least one light-emitting diode can be equipped with at least one discrete and/or common optical unit for beam guidance, for example at least one Fresnel lens, collimator, etc. Instead of or in addition to inorganic light-emitting diodes other materials can be used, for example InGaN or AlInGaP, organic LEDs (OLEDs, for example polymer OLEDs). The LED can be a filament LED. Alternatively, the at least one semiconductor light source can for example have at least one diode laser.

The fact that the at least one light source is located in the bulb can, in particular, mean that the at least one light source is located in a sealed bulb. The sealed bulb, in particular a glass bulb, can be filled with noble gas.

The driver serves for supplying the at least one light source with electrical operating signals such as an operating voltage and/or an operating current. The driver can have a printed circuit board or circuit board which is equipped with electronic components, for example SMD components. The driver can be connected by means of the base to a corresponding socket. The driver can be fastened in the base for example by adhesion, latching, jamming, soldering etc.

The supply lines (which can also be designated as conductors) can, in particular, be firmly connected to the bulb, for example at least parts can be embedded therein. The supply lines project out of the bulb towards the driver. For particularly simple and reliable insertion of the supply lines into the contact elements, the contact lines extend in a straight line in the direction of insertion (for example parallel to a longitudinal axis of the lamp) or in the direction of the driver.

The at least one contact element can, in particular, comprise or be two contact elements. The at least one contact element is electrically conductive and can be made of metal, for example copper, aluminum or a metal alloy, for example tin bronze. It can be coated for example with silver, zinc or tin. In particular the contact element can be made of CuSn6 coated with tin. CuSn6 is characterized by a particularly advantageous combination of cold formability, strength and hardness. CuSn6 is wear-resistant, has a very good corrosion resistance and can be soldered well. This alloy also has good spring characteristics.

In a further embodiment, components are arranged on a circuit board of the driver and the height of the components on a side of the circuit board facing the bulb is greater than the height of the components on a side of the circuit board facing away from the bulb. This may be the case, for example, if the side facing the bulb is equipped with at least one capacitor. The side of the circuit board facing away from the bulb can also not be so equipped.

It is still a further embodiment that components are arranged on a circuit board of the driver and the height of the components, on a side of the circuit board facing away from the bulb, is greater than the height of the components on a side of the circuit board facing the bulb. The side of the circuit board facing the bulb can also not be so equipped.

In one embodiment the at least one contact element has an opening (designated as an "insertion opening" without limiting the generality); associated with the insertion opening is at least one tab which stands obliquely in a direction of insertion and is elastically able to pivot; and at least one tab is pushed away elastically by the inserted supply line. This results in the advantage that a particularly reliable mechanical, and therefore reliable electrical contact, between the power supply line and the contact element can be achieved, since its elastic resilience the tab presses on the power supply line. Moreover, the tab can prevent the power supply line from loosening or sliding out, since in this case it clamps onto the power supply line and so effects form-fitting retention. Moreover, the oblique orientation of the tab enables particularly simple fitting of the power supply line into the contact element.

In a further embodiment the contact element is a sheet metal part, since it is then particularly inexpensive and can be simply produced and formed. Particularly in this case, the contact element can also be designated as a contact lug. It is also advantageous for simple production that at least one tab is a sheet metal region bent out of the insertion opening. This can be implemented in such a way that where an edge of the insertion opening is provided, at least one cutout, for example at least one slot, is introduced so that the sheet metal region surrounded, or delimited, by the cutout still holds together the rest of the contact element. For example, the cutout can be a U-shaped cutout. The cutout can be introduced, for example, by punching, laser cutting, cross cutting, etc. Then the sheet metal region delimited by the cutout can be bent round on a bending line (which, for example, closes the cutout). Thus, the fact that the sheet metal region or the tab is a sheet metal region bent out of the insertion opening can also mean, in particular, that the insertion opening is produced by bending the sheet metal region out of its previous plane. The sheet metal region or the tab is only bent down or bent out so far that the power supply line cannot be inserted (or introduced, fed in, etc.) without pushing away the tab.

A tab can be bent out of the insertion opening. Alternatively, two opposing tabs or sheet metal regions can be bent out of the insertion opening. When there is only one tab associated with the insertion opening or a power supply line inserted therein, the power supply line can for example rest on the tab and on an edge of the insertion opening.

The contact element is advantageously formed in a strip shape, since in this way it can be configured, in particular, to save on material and, moreover, can be reshaped simply.

In a further embodiment the contact element has a further region, in particular a sheet metal region, bent round into the region of the insertion opening, and the one tab bent out of the insertion opening as well as the bent-round region are pushed away elastically in opposite directions by the inserted power supply line. Thus, the advantage is achieved that the power supply line can be uniformly contacted from two sides and optionally can also be retained. Thus, the tabs can also be designed to be particularly long. The further bent-round region can also be designated as a further tab.

In a further embodiment, the bent-round region or the further tab is an end section of the contact element immediately adjoining the insertion opening. This facilitates production. The end section of the contact element can be bent on a bending line which extends over the entire width of the contact element, in particular perpendicularly to a longitudinal extent of the contact element.

In a further embodiment, a section of the contact element including the insertion opening is bent upwards in the direction of the bulb. As a result, the power supply line can be fed in particularly simply, and a particularly compact construction of the lamp can be achieved, in particular if the bulb there forms an inwardly projecting shaft.

Moreover, in one embodiment the driver has on the bulb side an electrically insulating covering cap which is designed as a support acting in the direction of insertion for the at least one contact element. An electrical insulation of the driver can be achieved by the covering cap, so that again air and leakage paths can be lengthened. This serves for user safety. Also, in this way the driver can be protected from adhesive or cement for fastening of the bulb to the base. Its further function as a support of the at least one contact element means that during feeding in or insertion of the power supply line the contact element is not bent away in the direction of the driver, which considerably simplifies the insertion.

In a further embodiment the covering cap has a shell-like shape and has an opening facing the driver. The covering cap can, in particular, be cylindrical or frustoconical, wherein in particular a top surface on the driver side can be open. The covering cap can be made of plastic, for example polybutylene terephthalate (abbreviation: PBT). The covering cap can laterally surround a circuit board of the driver. It can be connected by clamping to the circuit board.

In one embodiment, the covering cap has at least one aperture and the insertion opening is arranged congruently with respect to the opening. This further facilitates an insertion of the power supply line. The congruence means, in particular, that in the direction of insertion the aperture and the insertion opening are at least partially one behind the other and thus the power supply line can be guided into the aperture or through the aperture. The aperture can be introduced in a top surface of the covering cap on the bulb side. In principle, however, the order of aperture and insertion opening in the direction of insertion is arbitrary. Therefore, the contact element can also be located completely in the covering cap.

The covering cap can have external depressions or recesses in order advantageously to facilitate a better connection for the adhesive or cement between the base and the bulb.

In one embodiment the contact element has a bent-round fastening region which engages behind the covering cap. This results in the advantage that the contact element cannot be lifted off or cannot be lifted off significantly from the covering cap, which for example improves the positioning precision in the assembled state. In a further embodiment which is advantageous for simple and inexpensive provision of the fastening region, the bent-round fastening region is a sheet metal region, in particular in the form of a tab, bent out of an opening of the contact element. The fastening region can, for example, engage behind a web present in the covering cap. The web can separate two through openings in the covering cap from one another or, from a different point of view, can cross an aperture in the covering cap.

In another embodiment the covering cap has, on the bulb side, at least one protruding projection on which at least one contact element rests. Thus, a protrusion from the insertion opening of the contact element in front of the covering cap can also be achieved during an insertion operation. The projection protruding on the bulb side can be arranged on an upper face of a top surface of the covering cap on the bulb side. The projection protruding on the bulb side can be arranged on an edge of the insertion opening. The covering cap can have at least two projections per contact element, which are arranged adjacent to one another, in particular in relation to a longitudinal extent of the contact element.

In a further embodiment at least one contact element is fastened to a circuit board of the driver, since thus a mechanical and electrical contact with the driver can be achieved in a simple manner. The contact element can, for example, be soldered to a conductive track of the circuit board.

Also at least one contact element can extend starting from the circuit board internally along a side wall of the covering cap in the direction of the bulb. As a result, this section of the contact element is also protected mechanically and electrically by means of the covering cap.

Furthermore, at least one contact element can extend through the covering cap in order to be directed outwards, and then can be bent round so that it rests at least partially externally on the covering cap. As a result, support of the fed-through section of the contact element on the covering cap can be achieved in a simple manner.

In a further embodiment the contact element extends through a guide slot of the covering cap. The guide slot enables guiding and positioning of the contact element.

In a further embodiment at least one contact element is fastened to a rear face of a circuit board of the driver facing away from the bulb, for example it is soldered there to a conductive track of the circuit board. The conductive track can be guided laterally on the circuit board in the direction of the bulb. For this purpose, the circuit board can have respective cutouts on its side edge.

In a further embodiment the bulb has an inwardly leading shaft on its bottom (on the base side) facing the base. The shaft may be understood as a recess in the wall of the bulb, in particular the recess is at least approximately cylindrical. The shaft can, in particular, have a circular cross-section or such an external contour. In particular, in the event that the bottom is formed as a plate base or plate foot, this can have an annular outer region from which the shaft protrudes centrally into the bulb.

The object is also achieved by a method for producing a lamp as described above, in which the base with the driver located therein. The bulb is provided and the bulb is joined to the base so that the power supply lines of the bulb are inserted so as to make contact in a respective contact element of the base. The method can be configured by analogy with the lamp and produces the same advantages.

The lamp can be, in particular, a replacement lamp or "retrofit lamp" for replacement of conventional lamps, in particular if it has at least one semiconductor light source as light source. The lamp can be designed in particular for replacement of conventional incandescent lamps or halogen lamps.

The characteristics, features and advantages of this invention which are described above as well as the way in which these are achieved can be understood more clearly in connection with the following schematic description of an embodiment which is explained in greater detail in connection with the drawings. In this case for the sake of simplicity elements which are the same or equivalent can be provided with the same reference numerals.

DETAILED DESCRIPTION OF THE DRAWINGS

Figure 1:
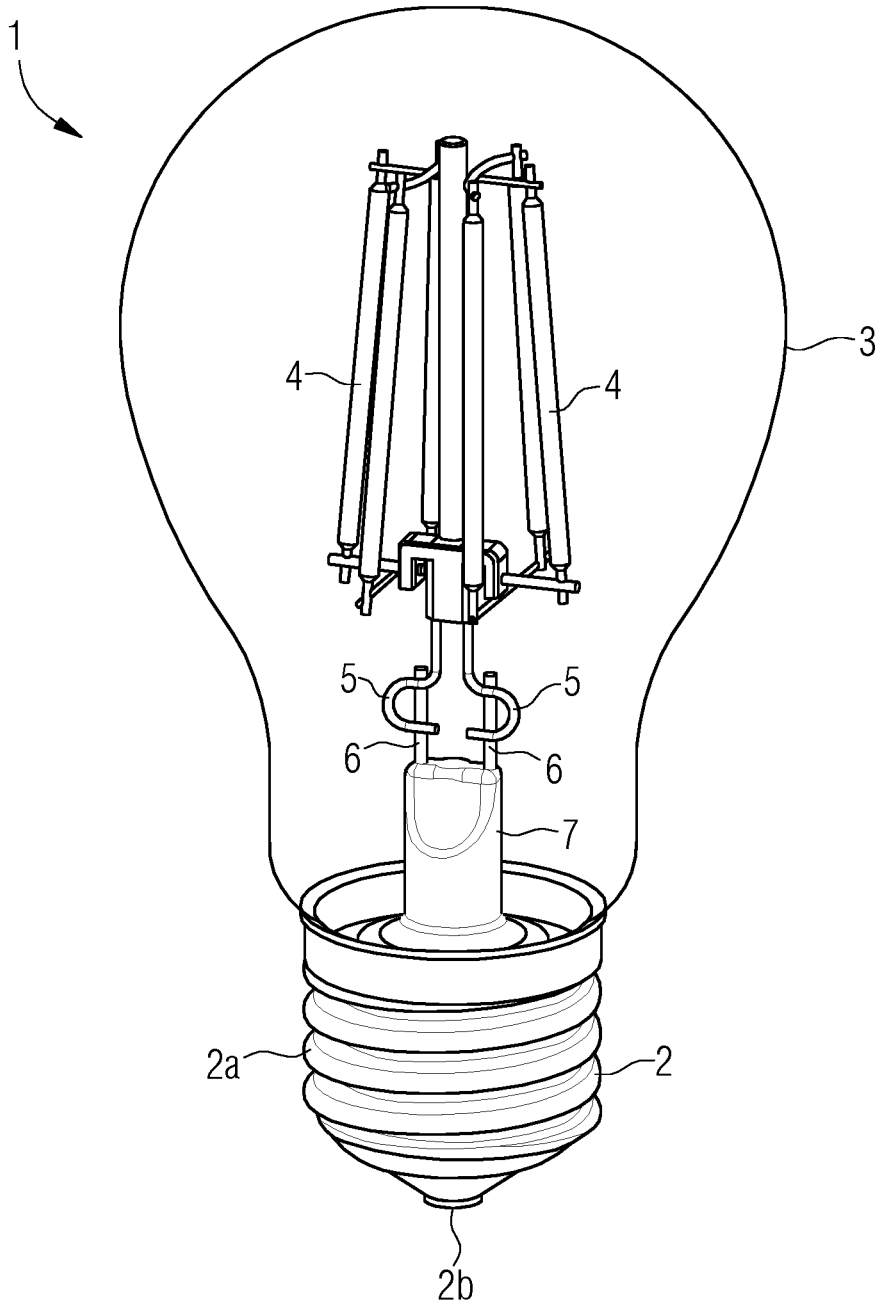
FIG. 1 shows an oblique view of a LED retrofit lamp.

FIG. 1 shows an oblique view of a LED retrofit lamp 1 with an Edison base 2 (e.g. of the E27 type) and a light-permeable bulb 3. The LED retrofit lamp 1 serves as a replacement lamp for replacement of a conventional incandescent lamp. For this purpose, the Edison base 2 has a metallic screw-like outer contact 2*a* and a foot contact 2*b* electrically disconnected from the outer contact 2*a*. The bulb 3 can be made of glass or plastic. A plurality of (in this case:

six) filament LEDs 4, which can be supplied with electrical power by means of two electrical busbar connections 5, are located in the bulb 3. In the bulb 3 the electrical busbar connections 5 are connected mechanically and electrically to current leads or power supply lines 6, for example soldered to one another. In this case the power supply lines 6 are designed as rectilinear wires which are directed outwards through the bulb 3 and in fact through a shaft 7 of the bulb 3 on the base side. The bulb 3 is hermetically sealed and can be filled, for example with noble gas.

Figure 2:
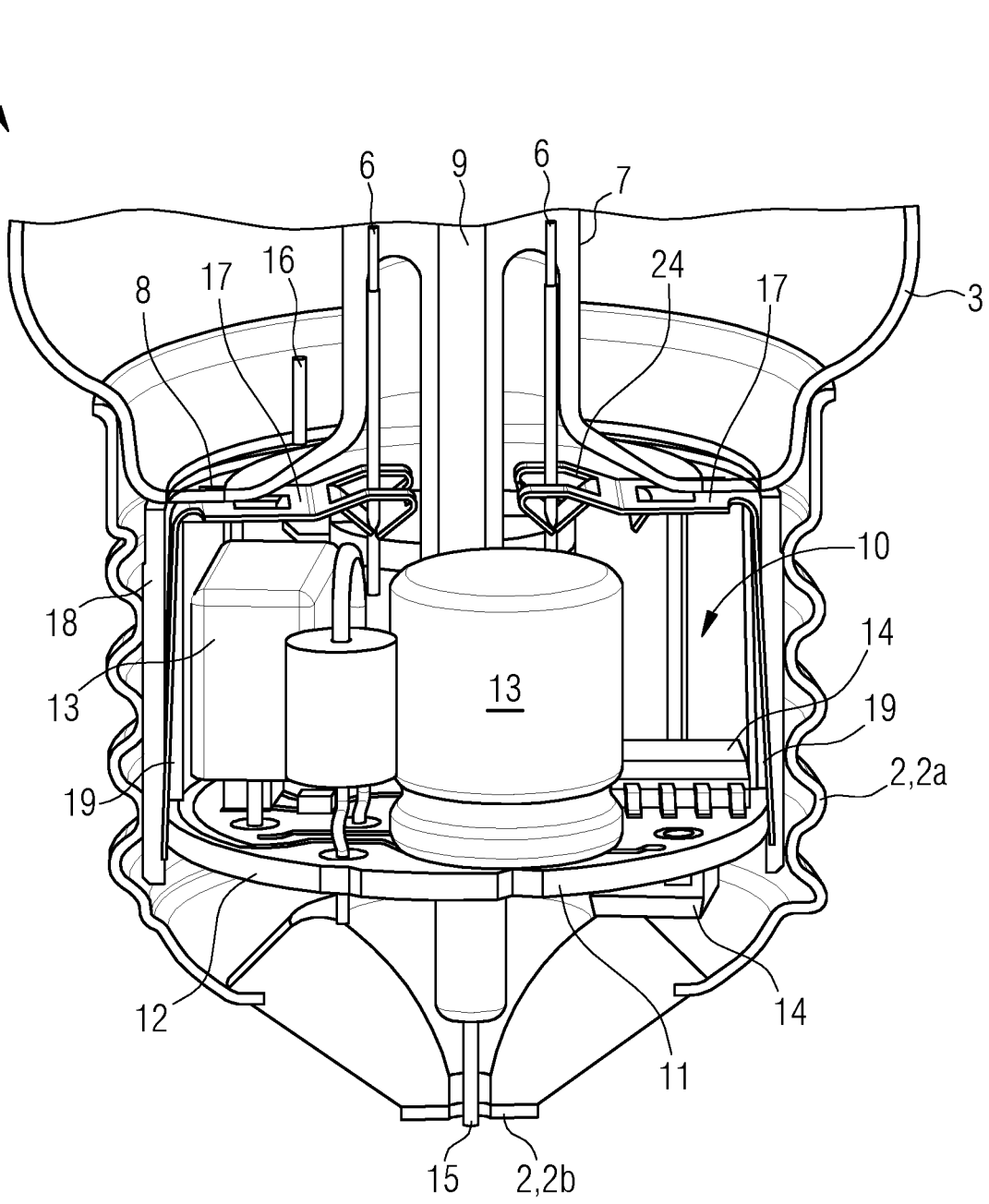
FIG. 2 shows the LED retrofit lamp in the region of the base as a sectional representation in an oblique view.

FIG. 2 shows the LED retrofit lamp 1 in the region of the base 2 as a sectional representation in an oblique view.

A bottom region 8 of the bulb 3 facing the base 2 is designed in the manner of a plate foot and merges centrally into the upwardly directed shaft 7. An elongated projection in the form of a hollow cylindrical tube ("pump tube" 9) extends centrally from the shaft 7, so that the pump tube 9 projects into the shaft 7. The pump tube 9 is concentric and thus is also arranged parallel to the shaft 7. It is oriented in the direction of the base 2. The pump tube 9 can be used for example in order to fill the noble gas into the bulb 3. It is closed off on the underside or on the base side.

Figure 3:
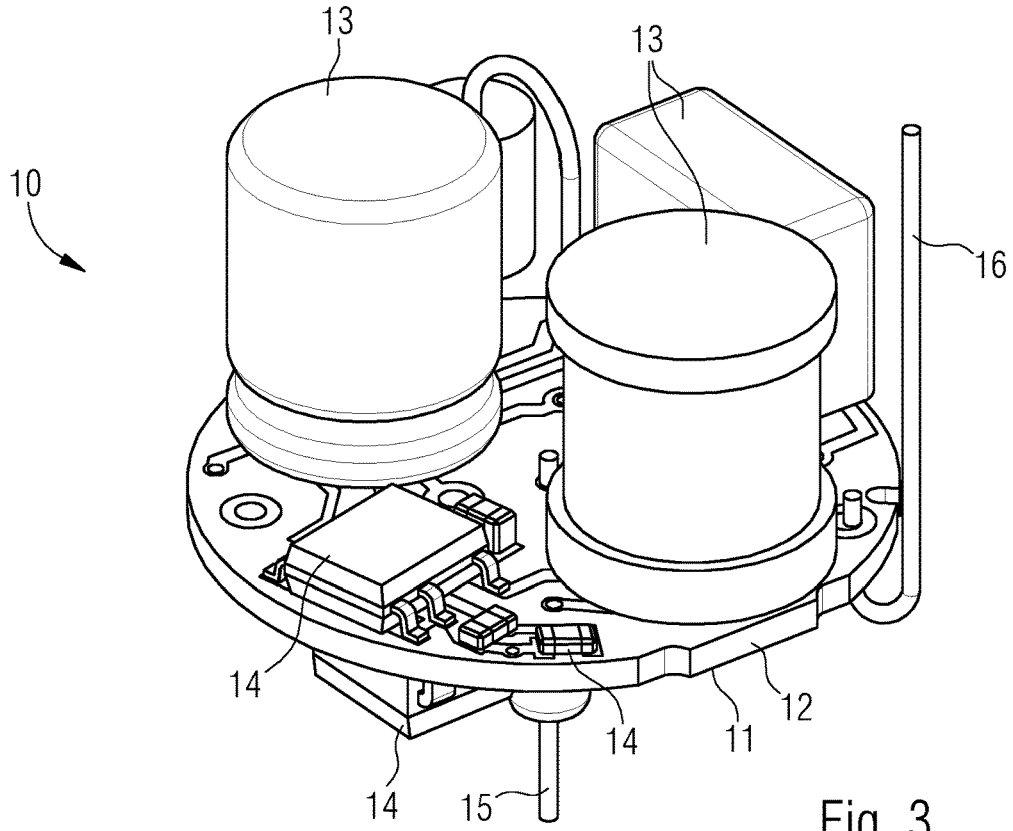
FIG. 3 shows a view obliquely from above of a driver of the LED retrofit lamp.
Figure 4:
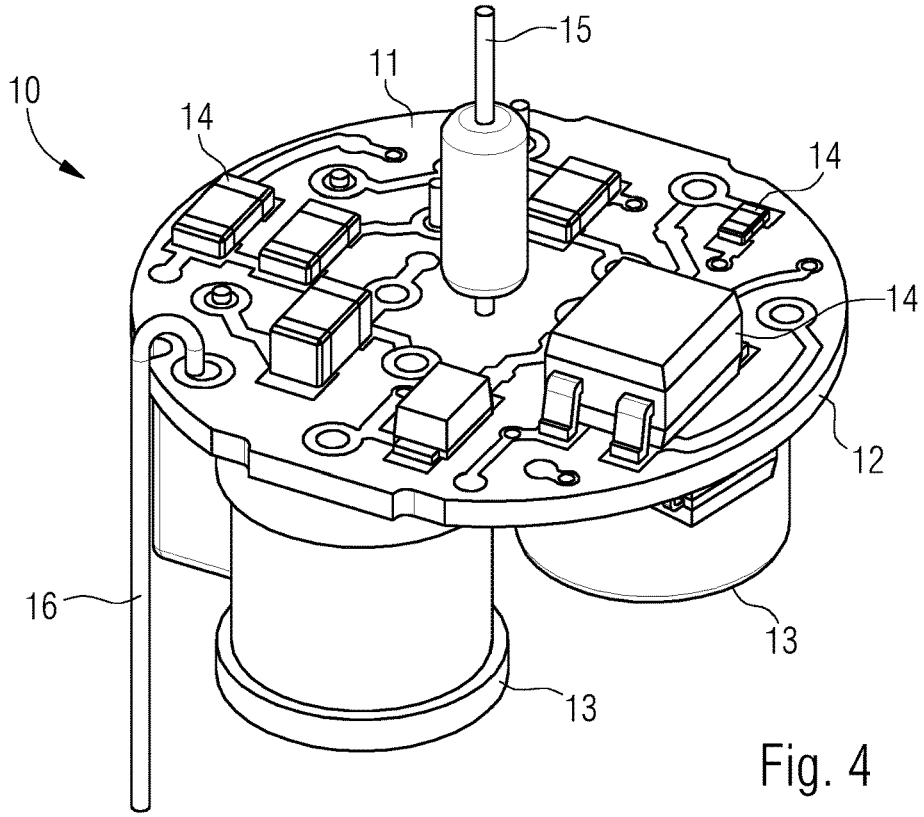
FIG. 4 shows a view obliquely from below of a driver of the LED retrofit lamp.

A driver 10 which is illustrated in isolation in FIG. 3 and FIG. 4 is located in the base 2. The driver 10 has a circuit board 11 shaped like a circular disc, which purely by way of example is equipped on both sides with components 13, 14. Furthermore, the driver 10 has a first contact wire 15 for connection to the foot contact 2*b* of the base 2 and a second contact 16 for contacting of the outer contact 2*a* of the base 2. As a result, the driver 10 is electrically connected on the input side to the foot contact 2*b* and the outer contact 2*a*, so that it can be supplied with electrical power by means of the base 2. From this the driver 10 generates electrical operating signals for operating the filament LEDs 4. In order that the operating signals generated by the driver 10 can reach the filament LEDs 4, the driver 10 is electrically connected by means of two contact elements 17 (see FIG. 2) to a respective power supply line 6.

Returning to FIG. 2, the driver 10 here is seated far down in the base 2, namely close to the foot contact 2*b*. In order to achieve this arrangement, low components 14 are arranged on the side of the circuit board 11 facing away from the bulb 3 or facing the foot contact 2*b* and high components 13 such as a capacitor and a coil are also arranged on the other side facing the bulb 3. Thus, the height of the components 13, 14 on a side of the circuit board 11 facing the bulb 3 is greater than the height of the components 14 on a side of the circuit board 11 facing away from the bulb 3.

A cylindrical covering cap 18 made of plastic extends from a side edge 12 of the circuit board 11 in the direction of the bulb 3. The covering cap 18 serves inter alia as an electrically insulating partition wall or lining to the outer contact 2*a*, in order to advantageously lengthen electrical creepage and air paths. For this purpose, the covering cap 18 bears internally against the outer contact 2*a* and projects as far as the bulb 3. In this case, for fastening, the covering cap 18 is fitted laterally on the circuit board 11 (optionally by latching). For a correct height adjustment, the covering cap 18 can have stop regions 19 internally.

The power supply lines 6 first extend outside the bulb 3 in part in the shaft 7 and extend in a straight line in the direction of the base 2 or driver 10 to before (in this case: below) the bulb 3. The power supply lines 6 with their free-standing end sections are inserted in the respective contact elements 17 and are thereby electrically contacted with the respective contact elements 17.

Figure 5A:
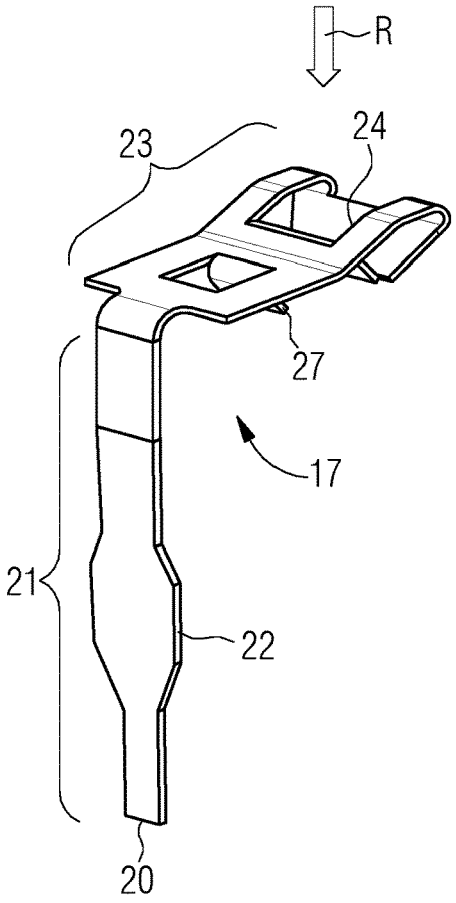
FIG. 5A shows a contact element of the LED retrofit lamp in a first oblique view.
Figure 5B:
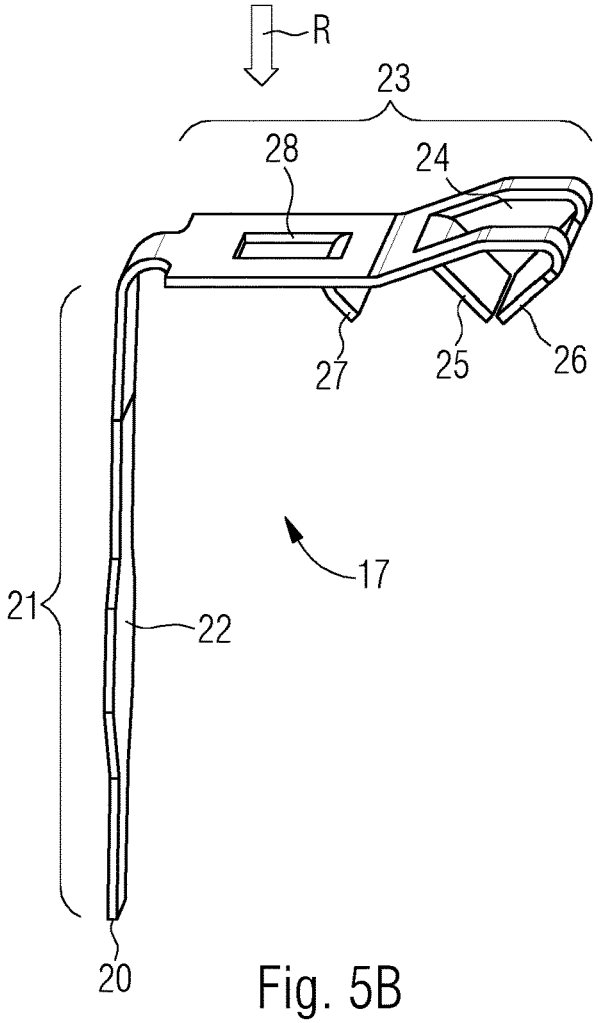
FIG. 5B shows the contact element according to FIG. 5A in a second oblique view.
Figure 5C:
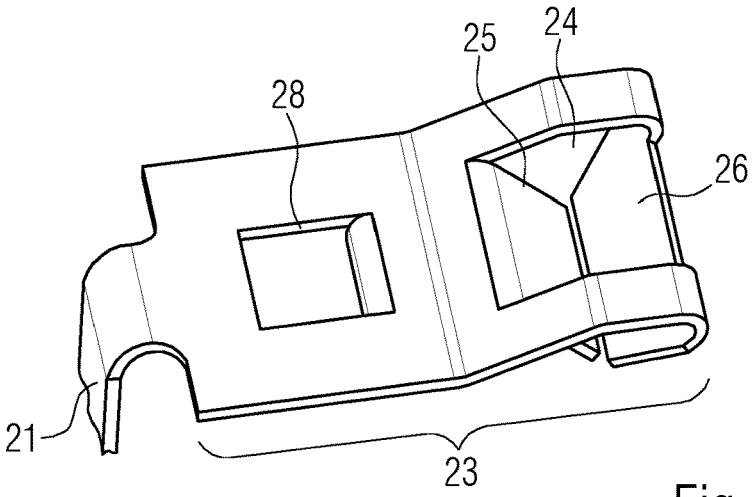
FIG. 5C shows a detail of the contact element according to FIG. 5A in a third oblique view.

FIG. 5A, FIG. 5B and FIG. 5C show the contact element 17 in respective oblique views. The contact element 17 is a sheet metal part in the form of a band or a strip with a lower connection end 20 for connection, for example soldering, to the circuit board 11. From the connection end 20, the contact element 17 extends upwards in a straight line and has a widened portion 22 on this ("insertion") section 21. Further on, the contact element 17 is bent round at right angles and merges into a further ("support") section 23.

In the support section 23, the contact element 17 has a rectangular insertion opening 24 which are associated with two part-regions in the form of tabs 25, 26 which stand obliquely in a direction of insertion R of the power supply line 6 (in this case: from the top downwards) oblique upright and are elastically able to pivot. In the illustrated non-installed state, the tabs 25 and 26 have a spacing between their front edges which is smaller than a width or thickness of the power supply line 6. After insertion of the power supply line 6 both tabs 25, 26 are pushed away, namely elastically in opposite directions. Thus, the two tabs 25, 26 hold a power supply line 6 by clamping it between them. Moreover, the two tabs 25, 26 form a respective feed-in or lead-in chamfer, so that a power supply line 6 to be inserted is guided thereby between the two tabs 25, 26, which considerably simplifies insertion or feeding in. Furthermore, to accomplish this the two tabs 25, 26 clamp onto the power supply line 6 and hold it by form fitting if the power supply line 6 is moved relative to the insertion opening 24 against the direction of insertion R.

While the tab 25 is a sheet metal region of the contact element 17 bent out of the insertion opening 24, the tab 26 is configured as a section of the contact element 17 which adjoins the insertion opening 24 and is bent round in the region of the insertion opening 24.

The insertion opening 24 or the support section 23 which includes the insertion opening 24 is bent up in part in the direction of the bulb 3.

On its section which is not raised between the insertion opening 24 and the insertion section 21 the support section 23 has a further tab 27 which is bent out of a further opening 28 in the direction of the driver 2.

Figure 6:
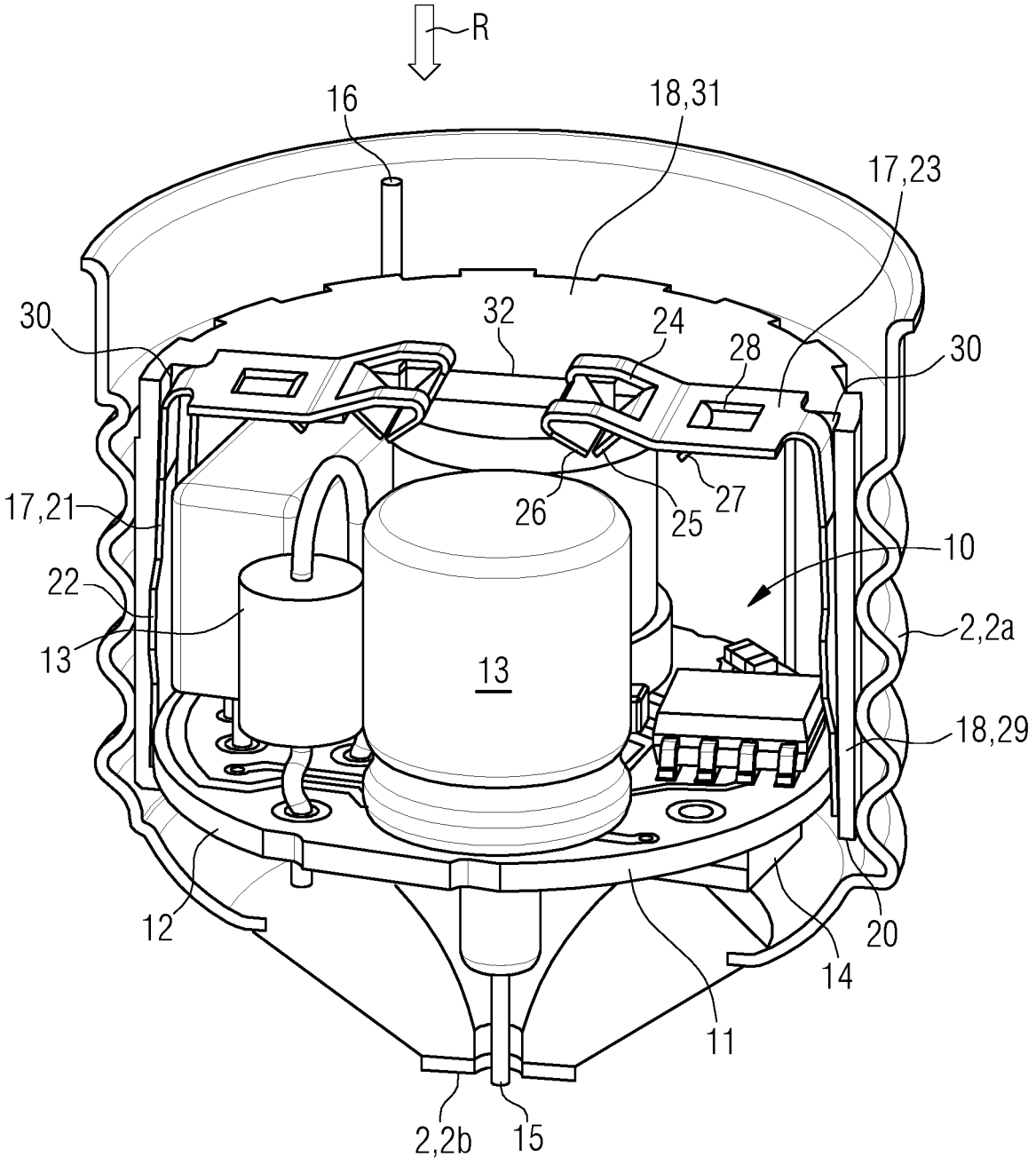
FIG. 6 shows in a sectional representation obliquely from above of the lamp without the bulb.
Figure 7:
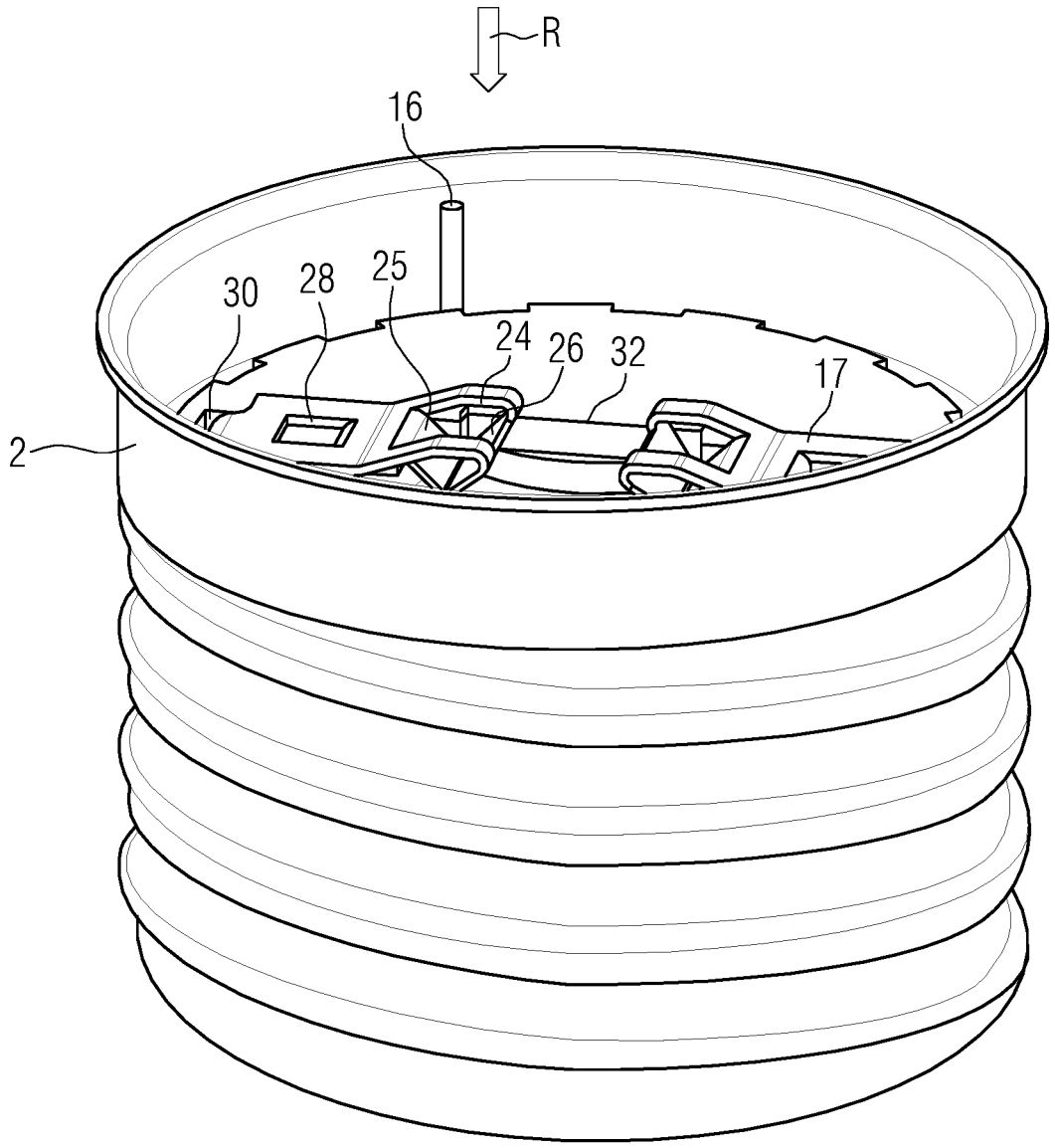
FIG. 7 shows the lamp without the bulb in a view obliquely from above.

FIG. 6 shows, in a sectional representation obliquely from above, the lamp 1 without the bulb 3 and thus also without the power supply lines 6. FIG. 7 shows the lamp 1 without the bulb 3 in a view obliquely from above.

The contact element 17 is fastened on a rear face of the circuit board 11 of the driver 10 facing away from the bulb and extends there past the side edge 12 of the circuit board 11 in the direction of the bulb 3. In this case with its insertion section 21 it extends initially internally along a side wall 29 of the covering cap 18 in the direction of the bulb 3. In this case the insertion section 21 extends in a respective guide slot 30, which is arranged at least approximately perpendicularly with respect to the circuit board 11 and is formed by means of the stop regions 19 on the inside of the side wall 29 of the covering cap 18. The guide slot 30 opens in an upper top surface 31 of the covering cap 18, so that the contact element 17 extends through the covering cap 18. Subsequently the contact element 17 lies with its bent-round support section 23 externally and facing the bulb 3 on the top surface 31 of the covering cap 18.

The top surface 31 has an aperture 32, above which the insertion opening 24 is located and into which the tabs 25, 26 protrude. As a result, when the bulb 3 and the base 2 are brought together the power supply lines 6 can extend through the respective insertion opening 24 and further through the aperture 32, as also illustrated in FIG. 2. The aperture 32 and the respective insertion opening 24 are thus arranged congruently in relation to the direction of insertion R.

Because the insertion opening 24 or the support section 23, which includes the insertion opening 24, is bent up in part in the direction of the bulb 3, a particularly compact design can be achieved since now a part of the shaft 7 can also be used to accommodate the contact elements 17, as likewise shown in FIG. 2. Also in this way, a spacing from the raised components 13 can be increased.

With its section present between the openings 28 and 24 the support section 23 is located externally on the covering cap 18, so that it acts as a support for the contact element 17 in the direction of insertion R.

Figure 8:
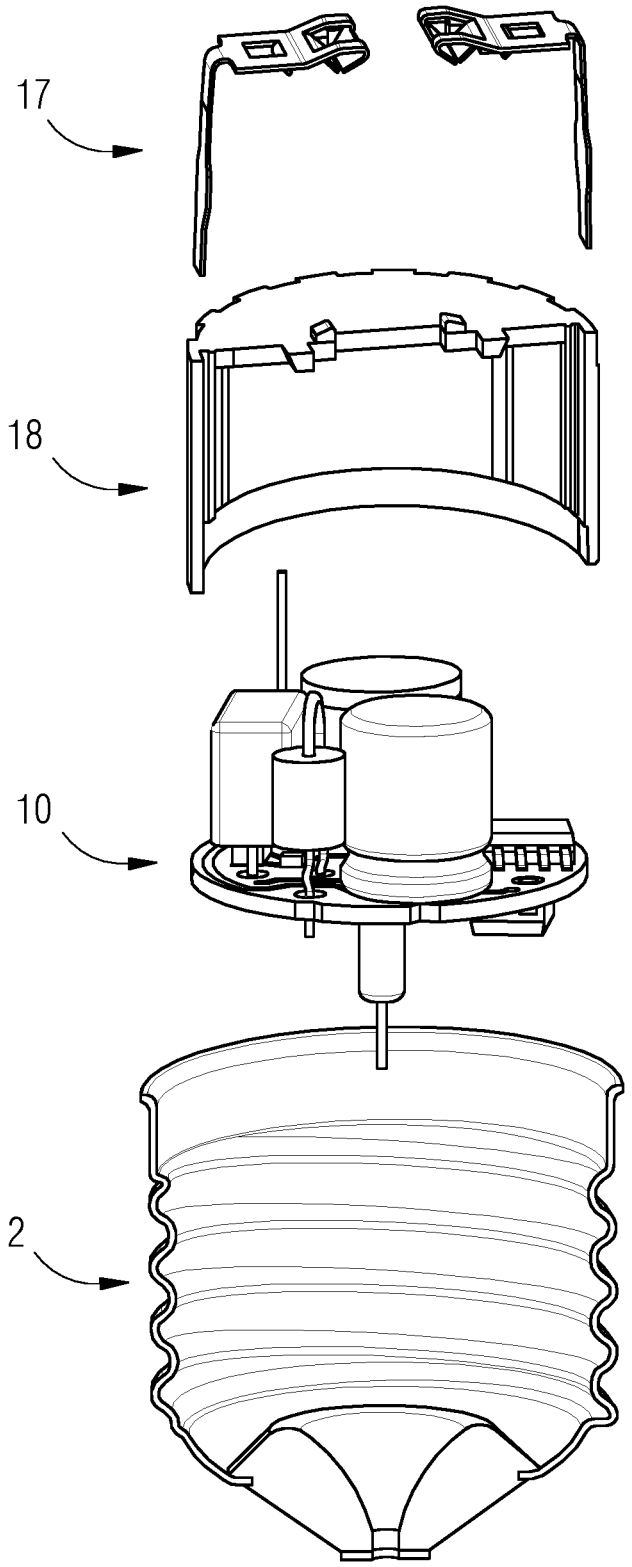
FIG. 8 shows an exploded representation in a side view with individual parts to be joined to the base before being combined with a bulb.

FIG. 8 shows an exploded representation in a side view of the individual parts to be joined to the base 2 before being combined with the bulb 3, namely the driver 10, the covering cap 18 and the two contact elements 17. This assembly is described more precisely in the following drawings.

Figure 9:
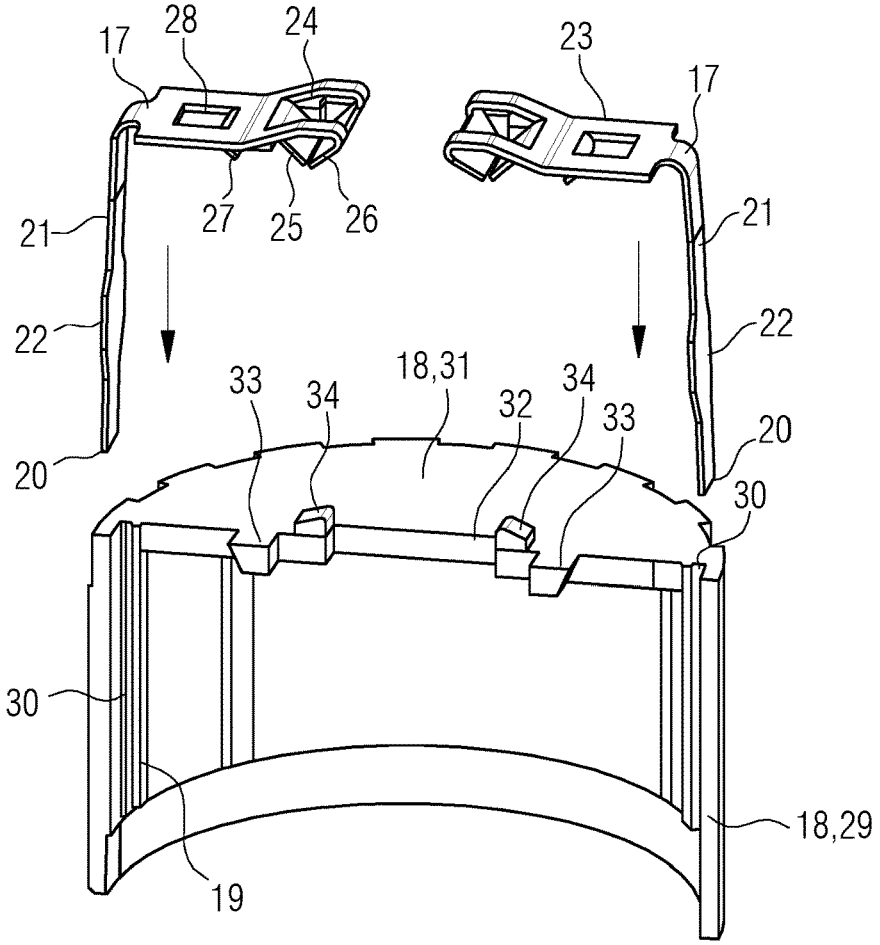
FIG. 9 shows an oblique view in a partially sectional representation of a covering cap with two contact elements before they are assembled.
Figure 10:
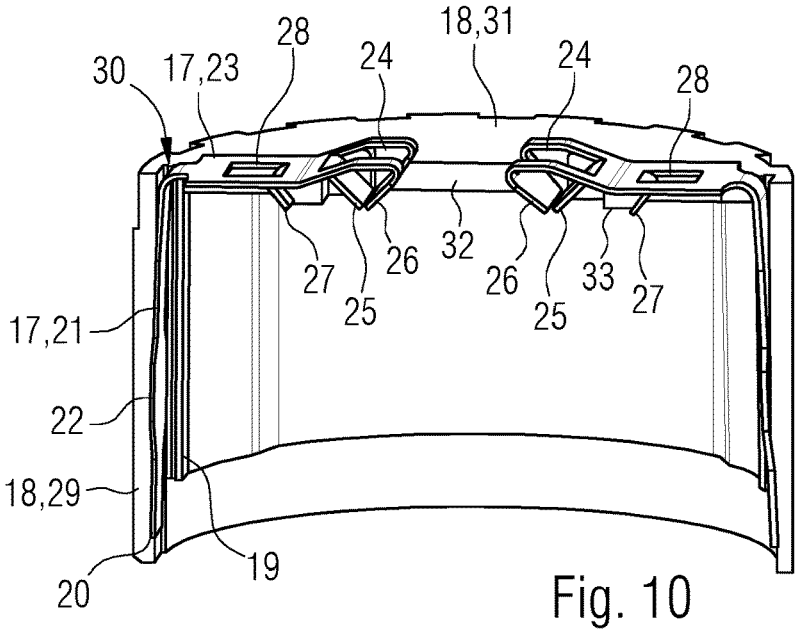
FIG. 10 shows the elements according to FIG. 9 in an assembled state.
Figure 11:
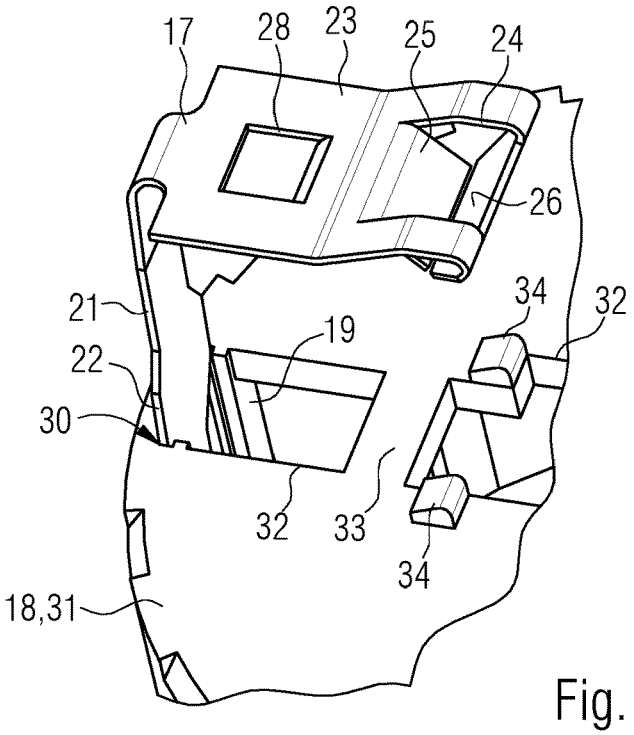
FIG. 11 shows a view obliquely from above of the covering cap with one of the contact elements during assembly.

First, as shown in an oblique view in FIG. 9 by means of a cut-away covering cap 18 and the two contact elements 17, the two contact elements 17 are inserted through the cover surface 31 with their insertion sections 21 into a respective guide slot 30 of the covering cap 18 (as indicated by the arrows), until the support section 23 rests on the top surface 31, which is shown in FIG. 10. As shown in a detail view obliquely from above in FIG. 11, the contact elements 17 are guided and retained with their widened areas 22 in the guide slot 30.

The support sections 23 of the contact elements rest on a respective web 33 of the cover surface 31. In this case the webs 33 cross the aperture 32. Moreover, the tabs 27 engage behind the respective web 33 and prevent lifting off (for example by bending upwards) of the support sections 23 from the cover surface 31. For this purpose, in a variant, the tabs 27 can be bent round after introduction into the aperture 32.

On its upwardly bent section the support section 23 rests on projections 34 protruding on the bulb side.

Figure 12:
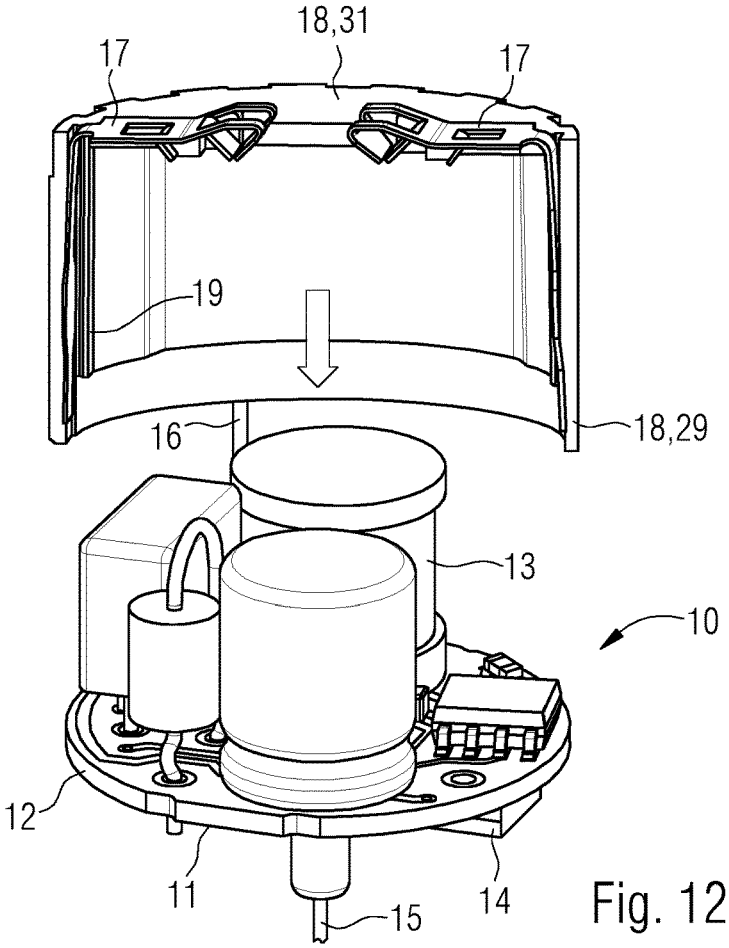
FIG. 12 shows an oblique view of the assembled elements according to FIG. 11 and a driver in a not yet assembled state.

As indicated by the arrow in FIG. 12, the covering cap 18 together with the contact elements 17 mounted thereon is now fitted with its open underside onto the circuit board 11 of the driver 10.

Figure 13:
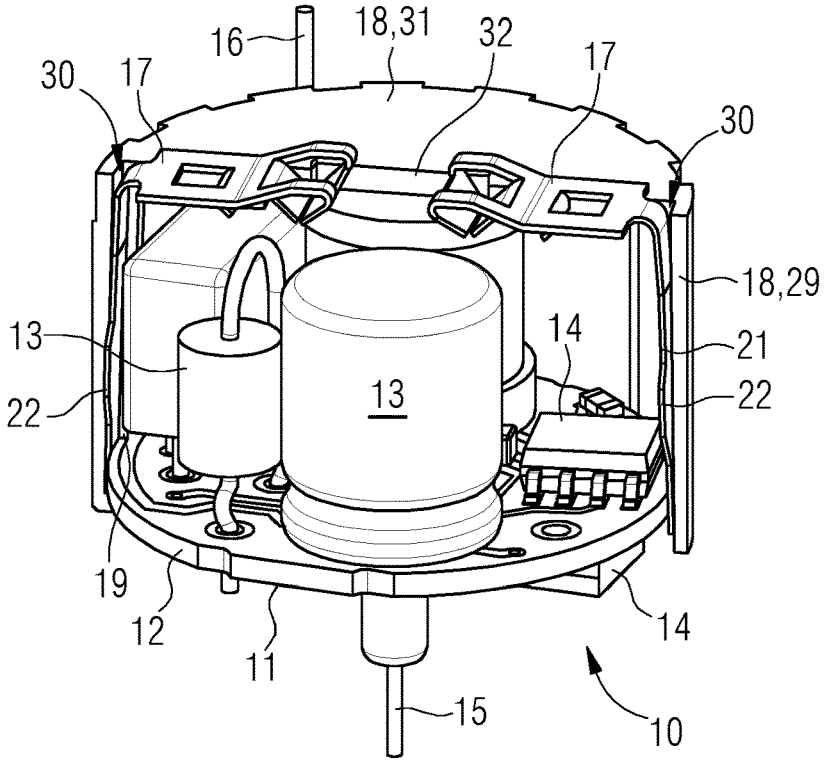
FIG. 13 shows an oblique view of the assembled elements according to FIG. 12 in an assembled state.

These components 10, 17, 18 are shown in their assembled state in FIG. 13. In this case the contact elements 17 go past the side edge 12 of the circuit board 11 as far as the rear face thereof. Thus, the connection ends 20 of the contact elements 17 are located in the region of the rear face of the circuit board 11 facing away from the bulb 3. The stop regions 19 forming the guide slots 30 lie on an upper face of the circuit board 11 or have been stopped there.

Figure 14:
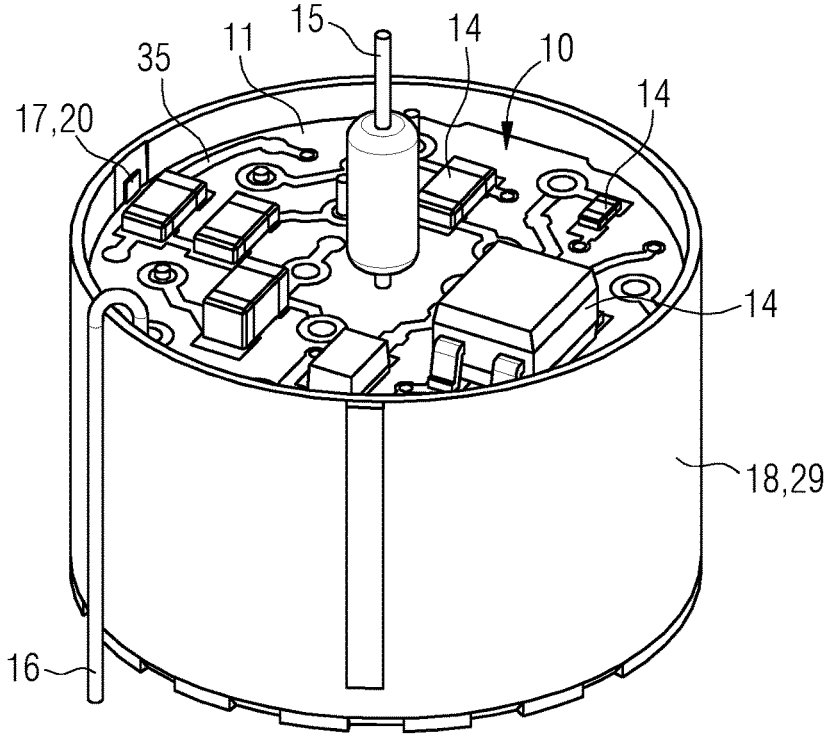
FIG. 14 shows a view of the assembled components according to FIG. 13 obliquely from below.
Figure 15:
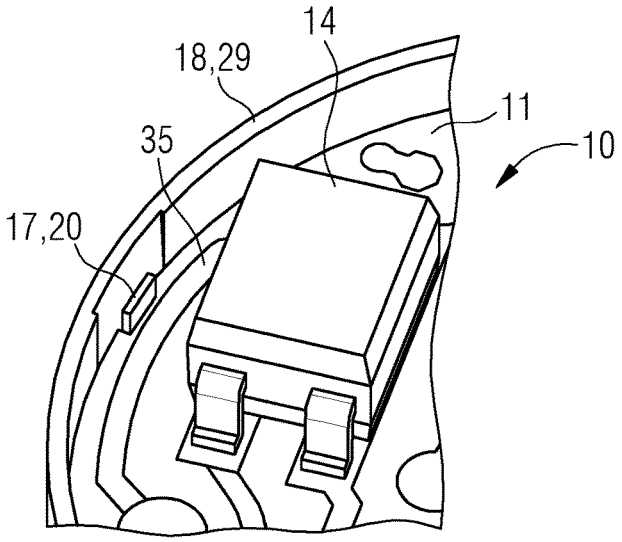
FIG. 15 shows a detail according to FIG. 14 in the region of the contact elements.

FIG. 14 shows a view of the assembled components 10, 17 and 18 obliquely from below. FIG. 15 shows a detail according to FIG. 14 in the region of one of the contact elements 17. The connection end 20 of the illustrated contact element 17 projects close to a conductive track 35 extending on the rear surface of the circuit board 11 of the driver 10. Thus, the connection end 20 can be simply contacted electrically with the conductive track 35, for example by means of a solder point (not shown).

The second contact wire 16 leads, as shown in FIG. 14, externally on the side wall 29 of the covering cap 18 in the direction of the bulb 3.

Figure 16:
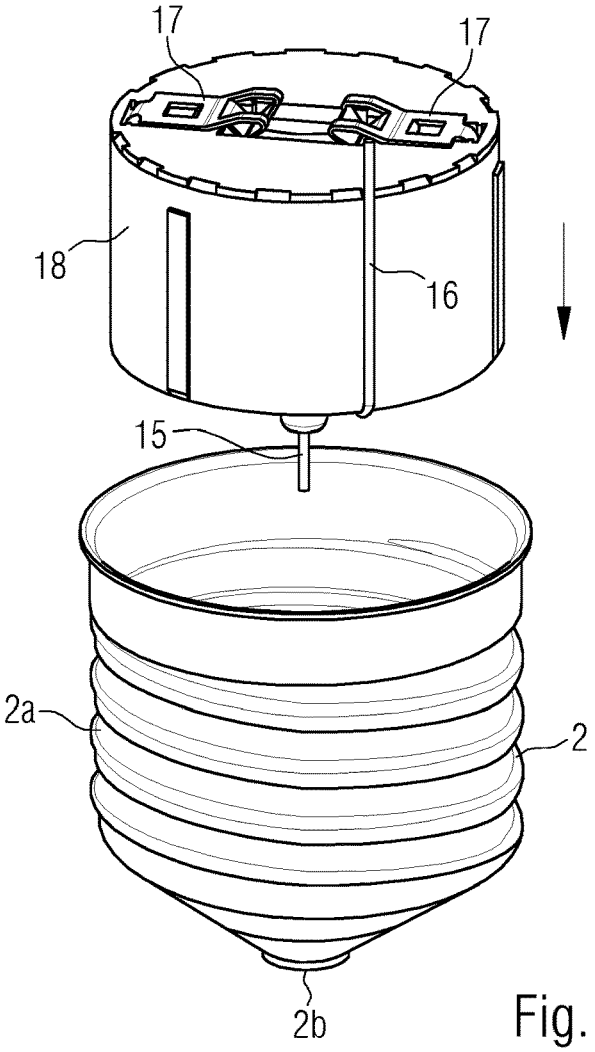
FIG. 16 shows a view obliquely from above of the components according to FIG. 15 together with a base.

As indicated by the arrow in FIG. 16, the assembled components 10, 17 and 18 are inserted into the base 2, which is illustrated in the assembled state in FIG. 2 and FIG. 6. In this case the components 10, 17 and 18 are retained by clamping in the base 2.

Figure 17:
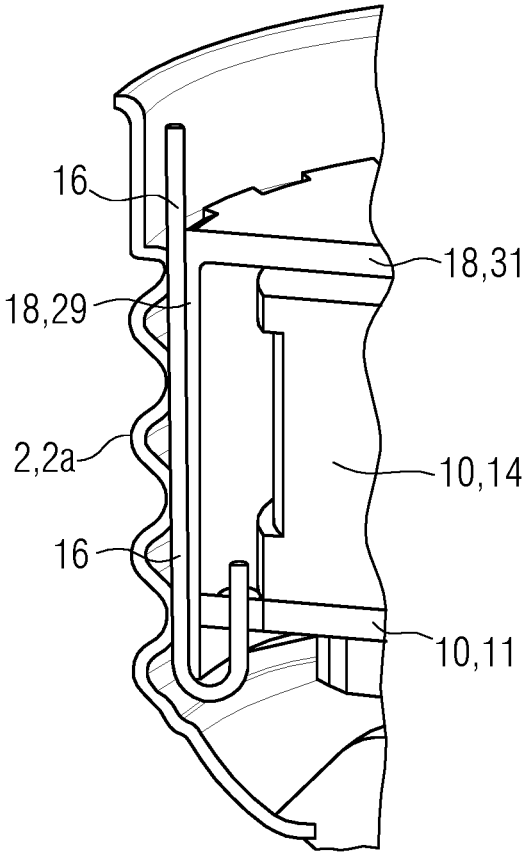
FIG. 17 shows a detail of a sectional representation in an oblique view of the components according to FIG. 16 in an assembled state.

Moreover, the second contact wire 16 is pressed onto an inner face of the outer contact 2*a* and thus is kept in reliable contact, as shown in FIG. 17.

The first contact wire 15 can be soldered to the foot contact 2*b*, so that the components 10, 17 and 18 are also retained by cohesion in the base 2. Furthermore, the components 10, 17 and 18 can be retained in the bulb 2 by additionally means, for example by latching, adhesion, etc.

In a further step (not shown) the bulb 3 with the power supply lines 6 is fitted onto the previously assembled components 2, 10, 17 and 18 and for example adhered to the base 2. With this combination of the bulb 3 with the components 2, 10, 17 and 18 to produce the finished lamp 1 the power supply lines 6 are also introduced without further measures into the insertion openings 24 and between the tabs 25, 26 and are retained there by clamping. Therefore, the combination can take place manually or fully automatically.

The illustrated lamp 1 has the further advantage that the design of the components 10, 17 and 18 and in particular 2, 10, 17 and 18 is particularly compact and robust and can be simply transported without damage. Thus, there are no components projecting over the base 2. Moreover, components which are delicate and susceptible to damage are avoided.

Although the invention has been illustrated and described in greater detail by the depicted exemplary embodiment, the invention is not restricted thereto and other variations can be deduced therefrom by the person skilled in the art without departing from the scope of protection of the invention.

Thus, the contact elements can also be attached to another point on the circuit board. They can also run in a different way. Thus, the position and the configuration of the contact elements can be chosen freely for the most part, which for example can simplify the arrangement of the components and the circuit board. For example, provision of an intermediate ring is made possible.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

LIST OF REFERENCES

LED retrofit lamp 1
Edison base 2
outer contact 2*a*
foot contact 2*b*
bulb 3
filament LED 4
busbar connection 5
power supply line 6
shaft 7
bottom region of the bulb 8
pump tube 9
driver 10
circuit board 11
side edge of the circuit board 12
high component 13
low component 14
first contact wire 15 second contact wire 16
contact element 17
covering cap 18
stop region 19
connection end of the contact element 20
insertion section of the contact element 21
widened portion 22
support section of the contact element 23
insertion opening 24
tab 25
tab 26
tab 27
opening 28
side wall of the covering cap 29
guide slot 30
top surface 31
aperture 32
web 33
projection 34
conductive track 35
direction of insertion R

The invention claimed is:

1. A lamp comprising:

a base;

a light-permeable bulb, which contains at least one light source; and a driver located in the base for supplying the at least one light source with electrical operating signals, wherein the bulb has outwardly directed power supply lines on the base side, wherein the driver has at least one contact element which projects in the direction of the bulb into which a free-standing section of the respective power supply line is inserted to make contact.

2. The lamp according to claim 1, wherein the at least one contact element has an insertion opening and at least one tab which stands obliquely in a direction of insertion and pivots elastically to associate with the insertion opening, and wherein the at least one tab is pushed away elastically by the inserted power supply line.

3. The lamp according to claim 1, wherein the at least one contact element is a band-shaped sheet metal part, the tab is a sheet metal region bent out of the insertion opening, the at least one contact element has a further region bent round into the region of the insertion opening, and the tab bent out of the insertion opening as well as the bent-round region are pushed away elastically in opposite directions by the inserted power supply line.

4. The lamp according to claim 3, wherein the bent-round region is an end section of the contact element immediately adjoining the insertion opening.

5. The lamp according to claim 1, wherein a section of the at least one contact element including the insertion opening is bent upwards in the direction of the bulb.

6. The lamp according to claim 1, wherein the driver has, on the bulb side, an electrically insulating covering cap which is designed as a support acting in the direction of insertion for the at least one contact element.

7. The lamp according to claim 6, wherein the covering cap has at least one aperture and the insertion opening is arranged congruently with respect to the at least one aperture.

8. The lamp according to claim 6, wherein the at least one contact element has a bent-round fastening region which engages behind the covering cap.

9. The lamp according to claim 6, wherein the covering cap has, on the bulb side, at least one protruding projection on which the at least one contact element rests.

10. The lamp according to claim 6, wherein the at least one contact element is fastened to a circuit board of the driver, extends internally along a side wall of the covering cap in the direction of the bulb, extends through the covering cap, and is then bent round so that it rests at least partially on the covering cap.

11. The lamp according to claim 10, wherein the at least one contact element extends through a guide slot of the covering cap.

12. The lamp according to claim 1, wherein the at least one contact element is fastened to a rear face of a circuit board of the driver facing away from the bulb.

13. A method for producing a lamp according to claim 1, the method comprising:

providing the base with the driver located therein; and joining the bulb to the base and inserting the power supply lines of the bulb to make contact in a respective contact element of the base.

* * * * *